US011574609B2

(12) United States Patent
Tsuchi et al.

(10) Patent No.: US 11,574,609 B2
(45) Date of Patent: Feb. 7, 2023

(54) DISPLAY DEVICE AND DATA DRIVER

(71) Applicant: LAPIS Semiconductor Co., Ltd., Yokohama (JP)

(72) Inventors: Hiroshi Tsuchi, Yokohama (JP); Koji Higuchi, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 17/560,190

(22) Filed: Dec. 22, 2021

(65) Prior Publication Data

US 2022/0114982 A1 Apr. 14, 2022

Related U.S. Application Data

(63) Continuation of application No. 16/689,080, filed on Nov. 20, 2019, now Pat. No. 11,217,196.

(30) Foreign Application Priority Data

Nov. 22, 2018 (JP) ..... JP2018-218979
Mar. 26, 2019 (JP) ..... JP2019-058712

(51) Int. Cl.
*G09G 3/36* (2006.01)

(52) U.S. Cl.
CPC ..... *G09G 3/3688* (2013.01); *G09G 2300/0828* (2013.01); *G09G 2300/0861* (2013.01);
(Continued)

(58) Field of Classification Search
CPC ..... G09G 3/3688; G09G 2300/0828; G09G 2300/0861; G09G 2300/0871;
(Continued)

(56) References Cited

U.S. PATENT DOCUMENTS

2011/0157259 A1 6/2011 Tanaka et al.
2013/0286003 A1* 10/2013 Park ..... G09G 3/3685 345/214
(Continued)

FOREIGN PATENT DOCUMENTS

CN 1641728 7/2005
CN 1855211 11/2006
(Continued)

OTHER PUBLICATIONS

"Office Action of China Counterpart Application" with English translation thereof, dated Jan. 21, 2022, p. 1-p. 28.

*Primary Examiner* — Premal R Patel
(74) *Attorney, Agent, or Firm* — JCIPRNET

(57) ABSTRACT

A display device and data driver are provided. The display device includes a plurality of data drivers provided for a predetermined number of data lines in a plurality of data lines. The plurality of data drivers receive the serialized video data signal from the display controller, generate a modulated data timing signal whose period changes within the one frame period, and supply a gradation voltage signal to each of the predetermined number of data lines for each of data periods based on a data timing of the modulated data timing signal, each of data periods corresponding to the data timing of the modulated data timing signal.

11 Claims, 11 Drawing Sheets

(52) U.S. Cl.
CPC ..... *G09G 2300/0871* (2013.01); *G09G 2310/027* (2013.01); *G09G 2320/0223* (2013.01); *G09G 2330/021* (2013.01)

(58) Field of Classification Search
CPC ..... G09G 2310/027; G09G 2320/0223; G09G 2330/021; G09G 2320/0233; G09G 3/3291; G09G 3/3685; G09G 3/3225; G09G 3/3648; G09G 3/2096; G09G 3/20; G09G 3/3611; G09G 3/3696; G09G 2310/08
See application file for complete search history.

(56) References Cited

U.S. PATENT DOCUMENTS

| | | | | |
|---|---|---|---|---|
| 2014/0176407 | A1* | 6/2014 | Choi | G09G 3/3648 345/87 |
| 2016/0125821 | A1* | 5/2016 | Lee | G09G 3/3688 345/92 |

FOREIGN PATENT DOCUMENTS

| | | |
|---|---|---|
| CN | 102119407 | 7/2011 |
| CN | 102222457 | 10/2011 |
| CN | 102376285 | 3/2012 |
| CN | 102768817 | 11/2012 |
| CN | 104361878 | 2/2015 |
| CN | 106023911 | 10/2016 |
| CN | 107274850 | 10/2017 |
| KR | 20050005672 | 1/2005 |

* cited by examiner

DISPLAY DEVICE AND DATA DRIVER

CROSS-REFERENCE TO RELATED APPLICATION

The present application is a continuation of application Ser. No. 16/689,080, filed on Nov. 20, 2019, which claims the priority benefits of Japan Patent Application No. 2018-218979, filed on Nov. 22, 2018 and Japan Application No. 2019-058712, filed on Mar. 26, 2019. The entirety of each of the above-mentioned patent applications is hereby incorporated by reference herein and made a part of this specification.

BACKGROUND

Technical Field

The disclosure relates to a display device and a data driver.

Description of Related Art

An active matrix driving system is adopted as a driving system of a display device such as a liquid crystal display or an organic electro luminescence (EL). In a display device of an active matrix driving system, a display panel is constituted by a semiconductor substrate in which pixel units and pixel switches are arranged in a matrix. Display is performed by controlling the turning on and turning off of the pixel switches using a gate signal, supplying a gradation voltage signal corresponding to a video data signal to the pixel units when the pixel switches are turned on, and controlling the luminance of each of the pixel units. The gate signal is supplied to a gate line by a gate driver, and a data signal is supplied through a data line by a data driver.

As a display device used in a TV or a monitor, there is a growing demand for a high-resolution and large-screen display device such as a 4K panel (pixel column: 3840× RGB, pixel row: 2160) or an 8K panel (two times the pixel column of a 4K panel, two times the pixel row thereof). For example, the standard size of a 4K panel is 65 inches diagonal, and the standard size of an 8K panel is 80 inches diagonal. The selection period of a gate signal (the pulse width of a gate signal) which is output from a gate driver becomes shorter with an increase in screen size and resolution of such a display panel, that is, an increase in the amount of video data. On the other hand, the load capacity of a data line of a display panel in which a data driver has to be driven increases, and a driving period per pixel in which the data driver is driven (a data period in which a gradation voltage signal is supplied to a data line) also becomes shorter in response to the selection period of a gate signal. In addition, the distance of a transmission channel of a video data signal supplied from a display controller to each data driver also expands.

In a case where the load capacity of a data line becomes larger and a driving period (data period) becomes shorter, a gradation voltage signal supplied from a data driver is a signal having little blunting of a rise in a signal waveform at a position on a data line located a relatively short distance from the data driver in one direction (for example, a longitudinal direction) among positions on a plurality of data lines (hereinafter referred to as a data line near end). On the other hand, the gradation voltage signal increases in blunting toward a position on a data line located a relatively long distance from the data driver in one direction (for example, a longitudinal direction) among positions a plurality of data lines (hereinafter referred to as a data line far end), which results in a decrease in the charging rate of a pixel electrode. For this reason, in a pixel column in the direction of a data line, a luminance difference with respect to the same gradation occurs, and thus image quality deterioration such as luminance non-uniformity occurs.

In order to solve a decrease in the charging rate of a pixel electrode, a display device that modulates the pulse width of a gate signal or the driving period (data period) of a gradation voltage signal and averages a pixel charging rate has been proposed (for example, Japanese Patent Laid-Open No. 2003-122309). In such a display device, a control circuit supplies a video data signal for modulating a driving period (data period) to a data driver in accordance with a distance from the data driver. In addition, the control circuit supplies a gate signal for modulating the pulse width of a gate signal to a gate driver in accordance with modulation in a driving period (data period).

PATENT DOCUMENT

[Patent Document 1] Japanese Patent Laid-Open No. 2003-122309

In a large-screen display device, since a distance between a control circuit (for example, a display controller) and each driver is long, a video data signal may be sent as a high-speed serial signal in accordance with the number of transmission channels from the control circuit to each driver. As disclosed in Japanese Patent Laid-Open No. 2003-122309, in a case where the control circuit sends a modulation signal to each driver, one data period on a data line near end is required to be shortened in order to extend one data period on a data line far end within one frame period in which data rewriting equivalent to one screen is performed. For example, in order to shorten one data period on the data line near end to a half, the transmission frequency of the video data signal has to be doubled. In a case where the increase rate of the transmission frequency of the video data signal is great, the performance of components in a transmission channel is increased to cope with a high frequency, that is, a change to high-priced components is performed, and thus the cost of the entire system rises. In addition, in the control circuit itself, a change of a circuit configuration for coping with an increase in frequency also occurs. The transmission frequency of the video data signal in a 4K panel or an 8K panel is already a high frequency of a giga Hz order, and it is not easy to raise the transmission frequency of the video data signal.

SUMMARY

According to an embodiment of the disclosure, there is provided a display device including: a display panel having a plurality of data lines, a plurality of gate lines, and pixel switches and pixel units provided in a matrix at intersection portions between the plurality of data lines and the plurality of gate lines; a display controller that generates a video data signal serialized at a fixed period for each of a predetermined number of data lines in the plurality of data lines; a gate driver that supplies gate signals to the plurality of gate lines in a predetermined order within one frame period, the one frame period corresponding to a rewriting time of one screen according to the video data signal, each of the gate signals having a pulse width which corresponds to a selection period for controlling the pixel switch to be on and corresponds to a period of a gate timing signal, the period of the gate timing signal being changed; and a plurality of data drivers that are provided for the predetermined number of data lines, the plurality of data drivers receiving the serialized video data signal from the display controller, generate a modulated data timing signal whose period changes within the one frame period, and supply a gradation voltage signal to each of the predetermined number of data lines for each of data periods based on a data timing of the modulated data timing signal, the gradation voltage signal corresponding to each of video data obtained by performing parallel conversion of the serialized video data signal, each of data periods corresponding to the data timing of the modulated data timing signal.

According to an embodiment of the disclosure, there is provided a data driver, connected to a display panel including a plurality of data lines, a plurality of gate lines, a pixel switch and a pixel unit, the pixel switch and the pixel unit being provided on each of the intersection of the data lines and the gate lines in a matrix form, the data driver supplying a gradation voltage signal corresponding to a video data signal to the plurality of data lines, the data driver comprising: a serial-parallel converter circuit that generates the video data which are converted in parallel, according to a predetermined number of data lines, from a serialized video data signal supplied from a display controller; a timing control circuit that generates, within one frame period corresponding to a rewriting time of one screen according to the video data signal, a modulated data timing signal whose period is changed so that a timing of writing the gradation voltage signal is different based on a distance on the data line to the pixel unit of a writing destination; a memory circuit that writes the video data based on a clock signal having a fixed period and temporarily storing the video data within a reading period corresponding to the modulated data timing signal; a digital to analog converter circuit that converts the video data signal to the gradation voltage signal; and an amplifying circuit that amplifies the gradation voltage signal and outputs the amplified gradation voltage to the predetermined number of data lines for each of one data periods which are set based on a data timing of the modulated data timing signal.

According to an embodiment of the disclosure, there is provided a display device including: a data driver that receives a video data signal having a predetermined period and a first timing signal having a predetermined period, generates a second timing signal whose period changes within a display period displayed by the video data signal, generates groups of third timing signals corresponding to a period of the second timing signal based on the first timing signal, and outputs a gradation voltage signal corresponding to a video data which is included into the video data signal; a control unit that transmits the video data signal and the first timing signal to the data driver; a gate driver that receives the groups of third timing signals transmitted from the data driver and transmits a scan signal which has a pulse width corresponding to the period of the groups of third timing signals; and a display panel including a plurality of data lines, a plurality of gate lines, a pixel switch and a pixel unit, the pixel switch and the pixel unit being provided on each of the intersection of the data lines and the gate lines, wherein the period of the second timing signal and the period of the groups of third timing signals change within the display period so that a timing of the second timing signal and a timing of the groups of third timing signals are different based on a distance on the data line from the data driver to the pixel unit.

According to an embodiment of the disclosure, there is provided a display device including: a data driver that receives a video data signal having a predetermined period and a setting information for setting gate timing, generates a data timing signal whose period changes within a display period displayed by the video data signal, generates groups of gate timing signals corresponding to a period of the data timing signal based on the setting information, and outputs, based on the data timing signal, a gradation voltage signal corresponding to a video data which is included into the video data signal; a gate driver that receives the groups of gate timing signals transmitted from the data driver and transmits a scan signal which has a pulse width corresponding to the period of the groups of gate timing signals; and a display panel including a plurality of data lines, a plurality of gate lines, a pixel switch and a pixel unit, the pixel switch and the pixel unit being provided on each of the intersection of the data lines and the gate lines, wherein the period of the data timing signal and the period of the groups of gate timing signals change within the display period so that a timing of the data timing signal and a timing of the groups of gate timing signals are different based on a distance on the data line from the data driver to the pixel unit.

According to the display device of the disclosure, it is possible to suppress deterioration in image quality while suppressing an increase in the scale of the device.

DESCRIPTION OF THE EMBODIMENTS

Figure 1:
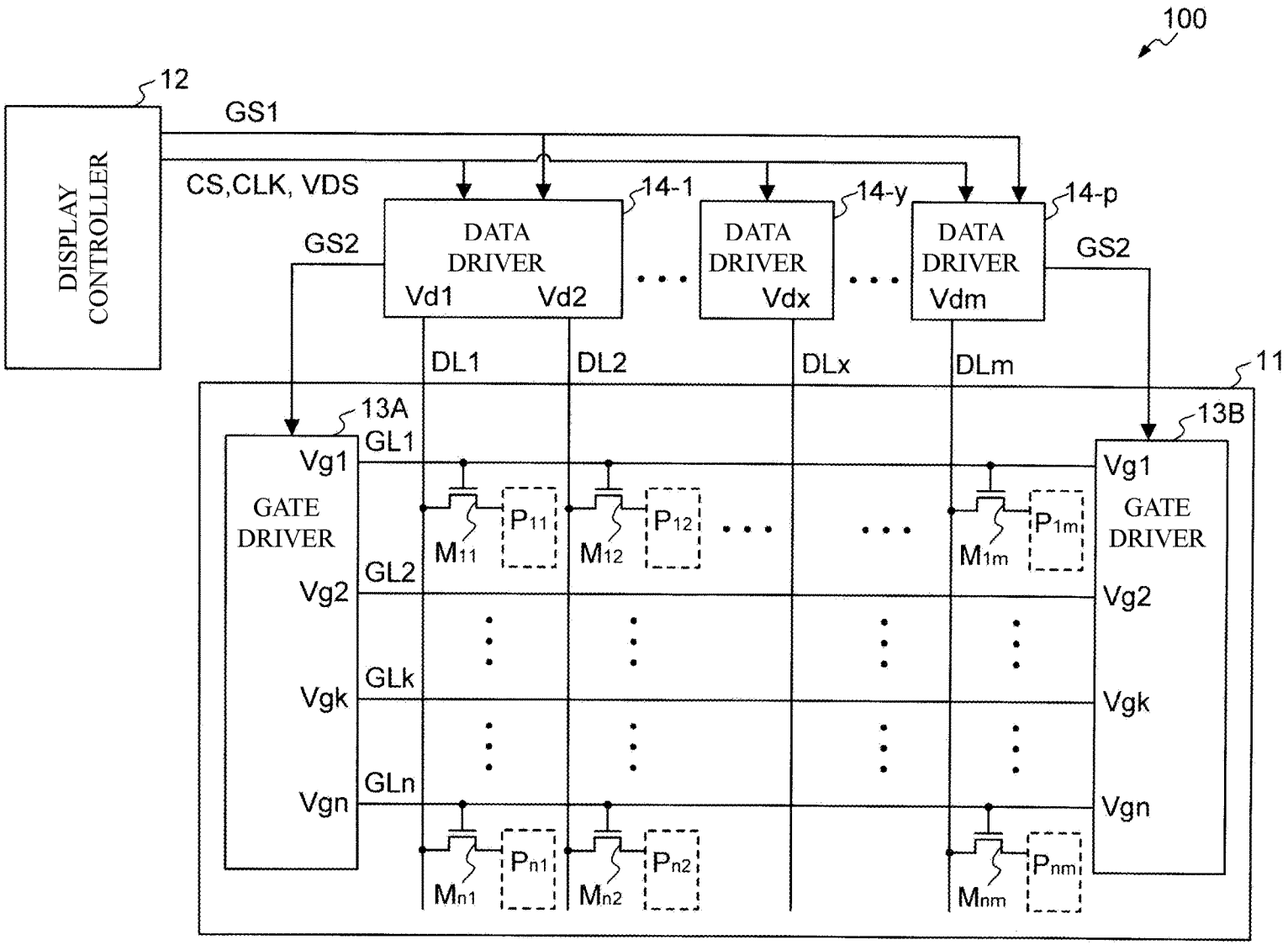
FIG. 1 is a block diagram illustrating a configuration of a display device of Example 1.

Hereinafter, suitable examples of the disclosure will be described in detail.

Meanwhile, in the following description and accompanying drawings in each example, substantially the same or equivalent portions are denoted by the same reference numerals and signs.

Example 1

FIG. 1 is a block diagram illustrating a configuration of a display device 100 of the present example. The display device 100 is, for example, a liquid crystal display of an active matrix driving system, and includes a display panel 11, a display controller 12, gate drivers 13A and 13B, and data drivers 14-1 to 14-*p*.

The display panel 11 is constituted by a semiconductor substrate in which a plurality of pixel units $P_{11}$ to $P_{nm}$ and pixel switches $M_{11}$ to $M_{nm}$ (n and m are natural numbers equal to or greater than 2) are arranged in a matrix. The display panel 11 includes n gate lines GL1 to GLn and m data lines DL1 to DLm disposed so as to intersect these gate lines. Meanwhile, in the following description, any one gate line out of the n gate lines GL1 to GLn may be denoted as a gate line GLk, and any one data line out of the m data lines DL1 to DLm may be denoted as a data line DLx. The pixel units $P_{11}$ to $P_{nm}$ and the pixel switches $M_{11}$ to $M_{nm}$ are provided at intersection portions between the gate lines GL1 to GLn and the data lines DL1 to DLm.

The pixel switches $M_{11}$ to $M_{nm}$ are controlled to be turned on or off in accordance with gate signals Vg1 to Vgn which are supplied from the gate driver 13.

The pixel units $P_{11}$ to $P_{nm}$ receive supply of gradation voltage signals Vd1 to Vdm corresponding to video data from the data drivers 14-1 to 14-*p*. When the pixel switches $M_{11}$ to $M_{nm}$ are turned on, the gradation voltage signals Vd1 to Vdm are supplied to the respective pixel electrodes of the pixel units $P_{11}$ to $P_{nm}$, and the respective pixel electrodes are charged. The luminance of the pixel units $P_{11}$ to $P_{nm}$ is controlled in accordance with the gradation voltage signals Vd1 to Vdm in the respective pixel electrodes of the pixel units $P_{11}$ to $P_{nm}$, and display is performed. Meanwhile, in the following description, any one gradation voltage signal out of the gradation voltage signals Vd1 to Vdm may be denoted as Vdx.

In a case where the display device 100 is a liquid crystal display, each of the pixel units $P_{11}$ to $P_{nm}$ includes a transparent electrode (not shown) connected to the data line via the pixel switch and a liquid crystal sealed between a semiconductor substrate and a counter substrate which is provided to face the semiconductor substrate and has one transparent electrode formed on its entire surface. Regarding a backlight located inside the display device, display is performed by the transmittance of a liquid crystal changing in accordance with a potential difference between the gradation voltage signals Vd1 to Vdm supplied to the pixel units $P_{11}$ to $P_{nm}$ and the voltage of the counter substrate.

The display controller 12 generates a clock signal CLK having a constant period of a clock pulse (hereinafter referred to as a clock period). The display controller 12 then supplies a video data signal VDS to the data drivers 14-1 to 14-*p* in accordance with a clock timing of the clock signal CLK. The video data signal VDS is configured as video data serialized in accordance with the number of transmission channels for each of a predetermined number of data lines.

In addition, the display controller 12 adds a control signal CS including various settings to the video data signal VDS. The clock signal CLK is formed by, for example, an embedded clocking scheme, and the video data signal VDS, the control signal CS, and the clock signal CLK that are used as an integrated serial signal are supplied to each of the data drivers 14-1 to 14-*p*, to thereby perform display control of each piece of video data VD.

In addition, the display controller 12 supplies a gate timing signal GS1 to the data drivers 14-1 and 14-*p* on both ends which are provided at positions close to the gate drivers 13A and 13B among the data drivers 14-1 to 14-*p*. The gate timing signal GS1 is a timing signal having a constant period.

The gate drivers 13A and 13B receive supply of a gate timing signal GS2 having a modulation period from the data drivers 14-1 and 14-*p*, and in response to this supply gate signals Vg1 to Vgn obtained by modulating the pulse width of the gate signals, that is, the selection period of the gate signals, to the gate lines GL1 to GLn. The pixel units Pu to $P_{nm}$ are selected for each pixel row by the supply of the gate signals Vg1 to Vgn. Data signals Vd1 to Vdm are then supplied from the data drivers 14-1 to 14-*p* to the selected pixel units, and thus the data signals Vd1 to Vdm are written in the pixel electrodes.

The data drivers 14-1 to 14-*p* are provided for each of a predetermined number of data lines obtained by dividing the data lines DL1 to DLm. For example, in a case where one data driver has 960 outputs, and the display panel includes one data line per pixel column, data lines are driven by twelve data drivers in a 4K panel and driven by twenty-four data drivers in an 8K panel. The data drivers 14-1 to 14-*p* receive supply of a serial signal in which the control signal CS, the clock signal CLK and the video data signal VDS are integrated with each other from the display controller 12 in each separate transmission channel. In a case where there are a pair of (two) transmission channels between the display controller 12 and each data driver, the pieces of video data VD and the control signals CS equal in number to outputs of a data driver are supplied as serialized differential signals in one data period.

Each of the data drivers 14-1 to 14-*p* generates video data VD obtained by parallel-developing the serialized video data signal VDS, and generates a modulated data timing signal of which the period changes within one frame period corresponding to a rewriting time of one screen. For example, the period of the modulated data timing signal changes stepwise within one frame period. The gradation voltage signals Vd1 to Vdm corresponding to the respective pieces of video data VD are supplied to the pixel units $P_{11}$ to $P_{nm}$ through the data lines DL1 to DLm on the basis of the data timing (data period) of the modulated data timing signal. The modulated data timing signal is set to have a timing (data period) varying according to a distance on a data line from each data driver to a pixel unit which is a writing destination. Specifically, within one frame period, one data period in which the gradation voltage signal is supplied to a pixel unit on a data line near end close to a data driver is set to be short, and one data period in which the gradation voltage signal is supplied to a pixel unit on a data line far end distant from a data driver is set to be long.

Here, in the present specification, the pixel unit on a data line near end is equivalent to a pixel unit provided at an intersection portion between a gate line and a data line, and a pixel unit provided at a position on a data line where a distance in one direction (a longitudinal direction in the example of FIG. 1) between a data driver and the pixel unit is relatively close among positions on a plurality of data lines.

In addition, the pixel unit on a data line far end is equivalent to a pixel unit provided at an intersection portion between a gate line and a data line, and a pixel unit provided at a position on a data line where a distance in one direction (a longitudinal direction in the example of FIG. 1) between a data driver and the pixel unit is relatively distant among positions on a plurality of data lines.

In addition, the data driver 14-1 located at the left end portion among the data drivers 14-1 to **14-*p* is connected to the gate driver 13A through a signal line. In addition, the data driver 14-*p* located at the right end portion is connected to the gate driver 13B through a signal line. The data drivers 14-1 and 14-*p* receive supply of the gate timing signal GS1 having a constant period from the display controller 12, generate the gate timing signal GS2 having a period corresponding to the data timing of the modulated data timing signal (timing and pulse interval) on the basis of the gate timing signal GS1, and supply the generated signal to each of the gate drivers 13A and 13B. The gate timing signal GS2 is set so that the selection timing of a gate signal supplied to each gate line by the gate drivers 13A and 13B is set to a timing varying according to a distance on a data line from the data drivers 14-1 and 14-*p*. Specifically, within one frame period, the selection period of a gate signal in a pixel unit on a data line near end close to a data driver is set to be short, and the selection period of a gate signal in a pixel unit on a data line far end distant from a data driver is set to be long. The modulation periods of the modulated data timing signal and the gate timing signal GS2 are not independently set, but are mutually correlated in timing setting. In the following description, the data drivers 14-1 and 14-*p*** are referred to as specific drivers collectively.

Meanwhile, in FIG. 1, a control signal for timing adjustment between the data drivers 14-1 to **14-*p* may be supplied from, for example, specific drivers 14-1 and 14-*p*** to data drivers other than the specific drivers (not shown).

In addition, in FIG. 1, a configuration in which the gate timing signal GS1 supplied from the display controller 12 is replaced with setting information of the gate timing signal GS1, and the setting information is transmitted to at least the specific data drivers 14-1 and **14-*p* out of the data drivers 14-1 to 14-*p*** as a serial signal in which the video data signal VDS, the control signal CS, and the clock signal CLK are integrated with each other may be used.

In addition, in FIG. 1, the gate timing signal GS2 generated by the specific drivers 14-1 and **14-*p* may be configured by the groups of gate timing signals, and the groups of gate timing signals may be supplied to the gate drivers 13A and 13B, respectively. The gate drivers 13A and 13B may be configured so that the selection timing of a gate signal supplied to each gate line is generated by the timing synthesis of the groups of gate timing signals to be supplied to the gate drivers 13A and 13**B.

In addition, in FIG. 1, as the display controller 12 using a configuration for outputting a serial signal having a predetermined period including the video data signal VDS and the gate timing signal GS1 having a predetermined period, a conventional display controller that supplies a signal having a predetermined period can be used. The display device in FIG. 1 is configured by modulating the pulse width (the data period) of a data line output signal (a gradation voltage signal) at each of the data drivers 14-1 to **14-*p*. Further, the display device in FIG. 1 is configured by modulating the pulse width (the data period) of the data line output signal (the gradation voltage signal) and modulating the pulse width (the selection period) of the gate signal at the specific drivers 14-1 and 14-*p***.

In the configuration of FIG. 1, at the specific drivers 14-1 and **14-*p* located a short distance to the display panel 11 and the gate drivers 13A and 13B, the modulated data timing signal and the gate timing signal GS2 are generated to maintain a predetermined timing correlation. Therefore, timing lag caused by the influence of signal transmission channel with respect to the gate signal and the data line output signal (the gradation voltage signal) which are supplied to the gate line and the data line of the display panel 11** is not likely to occur, and high-quality display can be realized.

Figure 2:
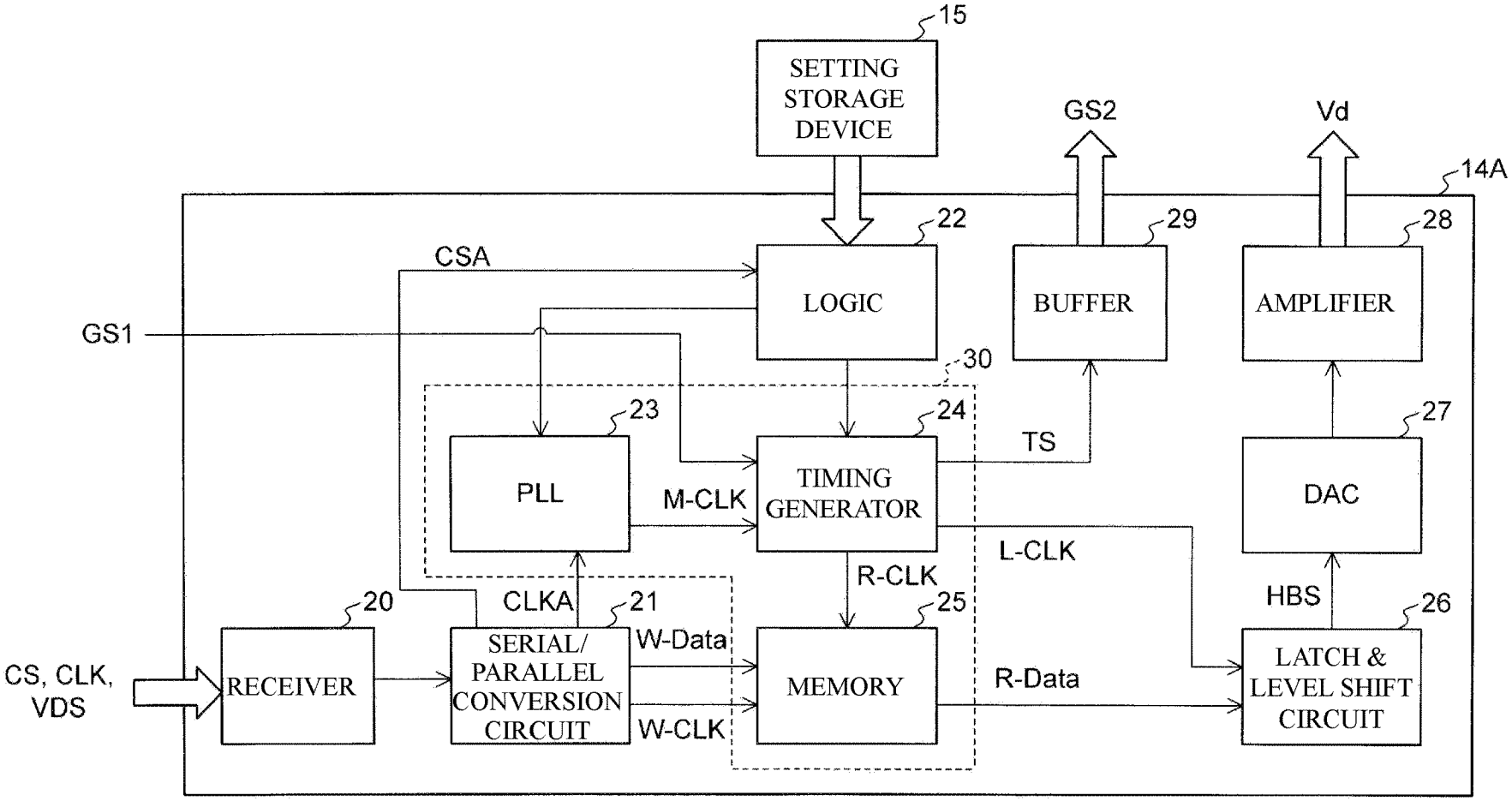
FIG. 2 is a block diagram illustrating a configuration of a main block of a specific driver among a plurality of data drivers.

FIG. 2 is a block diagram illustrating a configuration of a main block relating to control of the output timing (data period) of a gradation voltage signal Vd corresponding to the video data VD output from a predetermined number of output terminals and the output timing or pulse width of a gate signal based on the gate timing signal GS2, in a driver IC 14A constituting the data drivers 14-1 and **14-*p*** which are specific drivers.

The driver IC 14A includes a receiver 20, a serial/parallel conversion circuit 21, a logic circuit 22, a phase locked loop (PLL) 23, a timing generator 24, a memory 25, a latch & level shift circuit 26, a digital to analog converter (DAC) 27, an amplifier 28 and a buffer 29. The PLL 23, the timing generator 24 and the memory 25 constitute a timing controller 30. The serial signal (the control signal CS, the video data signal VDS, and the clock signal CLK) output from the display controller 12 and the gate timing signal GS1 are input to the driver IC 14A.

The receiver 20 is a reception device that receives the high-speed serial signal (the control signal CS, the video data signal VDS and the clock signal CLK) output from the display controller 12. The control signal CS, the video data signal VDS and the clock signal CLK on which high-speed serial transmission is performed are parallel-developed in the serial/parallel conversion circuit 21 through the receiver 20, and are separated from each other for each individual signal.

The serial/parallel conversion circuit 21 extracts a clock signal CLKA and a writing clock signal W-CLK having a constant frequency from the embedded clock signal CLK, supplies the clock signal CLKA to the PLL 23, and supplies the writing clock signal W-CLK to the memory 25. In addition, the serial/parallel conversion circuit 21 extracts a control signal CSA from the serialized control signal CS, and supplies the extracted control signal to the logic circuit 22. The control signal CSA includes, as necessary, setting information of the PLL 23 and the timing generator 24 which are controlled by the logic circuit 22. In addition, the serial/parallel conversion circuit 21 converts the video data signal VDS supplied as serial data into parallel data, and writes the video data VD converted into parallel data, as writing data W-Data, in the memory 25 in accordance with the clock timing of the writing clock signal W-CLK.

The logic circuit 22 controls the frequency modulation of the PLL 23 and the timing of the timing generator 24 in accordance with setting information which is set in advance or setting information from the control signal CSA. The logic circuit 22 includes, for example, a register or the like that temporarily stores a set value which is added or changed from the control signal CSA.

The PLL 23 generates a modulated clock signal M-CLK on the basis of the clock signal CLKA supplied from the serial/parallel conversion circuit 21. The PLL 23 performs frequency modulation on the clock signal CLKA in accordance with control of the logic circuit 22, and generates the modulated clock signal M-CLK.

The timing generator 24 receives the modulated clock signal M-CLK from the PLL 23. The timing generator 24 generates a modulated data timing signal of which the period changes within one frame period on the basis of the modulated clock signal M-CLK in accordance with the control of the logic circuit 22. The timing generator 24 generates and outputs a readout clock signal R-CLK and a latch clock signal L-CLK on the basis of the data timing (data period) of the modulated data timing signal. In addition, the timing generator 24 receives the gate timing signal GS1, and generates and outputs a gate timing signal TS having a period (timing and pulse interval) corresponding to the data timing of the modulated data timing signal on the basis of the gate timing signal GS1. The gate timing signal TS is amplified in the buffer 29, and is output from the driver IC 14A as the gate timing signal GS2.

The memory 25 writes the writing data W-Data in accordance with the clock timing of the writing clock signal W-CLK, and reads out video data R-Data in response to the readout clock signal R-CLK according to the modulation timing of one data period of a data signal. The memory 25 supplies the read-out video data R-Data to the latch & level shift circuit 26. Meanwhile, the memory 25 includes a memory capacity that temporarily stores the video data R-Data in a period according to a timing difference between the writing clock signal W-CLK having a constant period and the readout clock signal R-CLK having a modulation period.

The latch & level shift circuit 26 latches the video data R-Data in accordance with the latch clock signal L-CLK for determining an output timing of a gradation voltage signal from the driver IC 14A, level-converts the latched video data into a high-voltage bit signal (binary high-voltage digital signal) according to an output power supply voltage, and outputs a high-voltage bit signal HBS.

The DAC 27 receives input of the high-voltage bit signal HBS, selects (digital-analog converts) a gradation level voltage corresponding to the high-voltage bit signal HBS, and supplies the selected gradation level voltage to the amplifier 28 as an analog gradation voltage signal.

The amplifier 28 amplifies the gradation voltage signal selected in the DAC 27 and outputs the amplified gradation voltage signal to a data line. Meanwhile, in FIG. 2, each block of the memory 25, the latch & level shift circuit 26, the DAC 27, and the amplifier 28 is configured as a circuit group corresponding to the number of outputs of the driver IC 14A.

In addition, various types of setting information supplied to the logic circuit 22 may be configured to be supplied from the outside of the driver IC 14A separately from the control signal CSA sent from the display controller 12. For example, a setting storage device 15 constituted by an electrically erasable programmable read-only memory (EEPROM) or the like can also be provided outside the driver IC 14A. Change setting information for changing the setting of modulation of the pulse width of the gate timing signal GS2 and modulation of the data period of the gradation voltage signal Vd can also be stored in the setting storage device 15. For example, during the startup of the display device 100, the driver IC 14A reads out a set value stored in the setting storage device 15, and can also perform modulation of the pulse width of the gate timing signal GS2, modulation of the data period of the gradation voltage signal Vd, and timing change of each signal on the basis of the read-out set value. Meanwhile, the setting storage device 15 is configured to be able to appropriately change the stored set value in accordance with adjustment from the outside.

FIG. 2 has been described above as the configuration of the specific drivers 14-1 and 14-*p*, but data drivers other than the specific drivers 14-1 and 14-*p* may also be configured similarly to FIG. 2. In that case, the data drivers other than the specific driver are set to have the gate timing signal GS1 not input thereto, and not to output the gate timing signal GS2. For example, the data driver configured as in FIG. 2 may include a setting for stopping the operation of a circuit (not shown) that adjusts a gate timing within the timing generator 24 and stopping the operation of the buffer circuit 29 on the basis of the control signal CSA sent from the display controller 12 or setting information from the outside. Thereby, in the driver IC 14A, it is possible to switch a specific driver and other data drivers using the setting information to be supplied, and to enhance the versatility of the data driver.

In addition, in a case where a control signal for timing adjustment is supplied from the specific drivers 14-1 and 14-*p* to data drivers other than a specific driver, the specific drivers 14-1 and 14-*p* may be configured to output the control signal from the buffer 29. The data drivers other than a specific driver which receive a control signal may be configured to receive a control signal instead of the gate timing signal GS1.

Figure 3A:
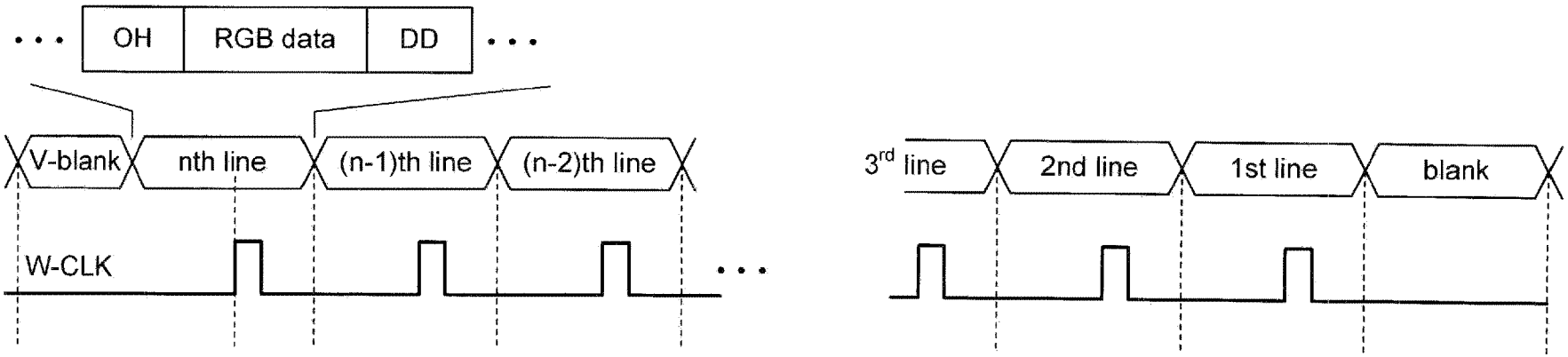
FIG. 3A is a timing chart illustrating a video data signal corresponding to a data line DLx and a timing of writing of video data in a memory.

FIG. 3A shows a timing chart in one frame period of the video data VD and an internal signal corresponding to output to the data line DLx in one data driver 14 out of the data drivers 14-1 to 14-*p*. The upper part of FIG. 3A represents the video data VD corresponding to the gate line GLn and the data line DLx in the serialized video data signal VDS. The middle part of FIG. 3A represents the data period of each piece of video data VD in which the serialized video data signal VDS is parallel-developed. The video data VD corresponding to the selection period of each gate line is sequentially transmitted in the order of the gate lines GLn, GL(n−1), . . . , GL1 (that is, the order from a side distant from a data driver toward a side close thereto). The lower part of FIG. 3A represents the clock signal W-CLK for controlling a timing at which the parallel-developed video data VD is written in the memory 25. Meanwhile, in the following description, one of the data drivers 14-1 to 14-*p* is simply referred to as the data driver 14.

As shown in the upper part of FIG. 3A, each piece of video data VD is constituted by an overhead OH including a start pulse, configuration data or the like, RGB data which is real data corresponding to the number of outputs of the data driver 14, and dummy data DD. The video data signal VDS is configured such that numerous video data VD according to the number of outputs of the data driver 14 are serialized. For example, in a case where the video data signal VDS is transmitted by a differential signal of a pair of (two) transmission channels, the video data signal VDS is configured to include the video data VD of the number of outputs of the data driver 14 in one data period shown in the middle part of FIG. 3A, and the period of the video data signal VDS is set to 1 over the number of outputs in one data period. Therefore, the clock signal CLK buried in the video data signal VDS is set to have a very high frequency.

As shown in the middle part of FIG. 3A, the head and end of the video data signal VDS are provided with a blank period (shown as V-blank and blank). The control signal CS including various types of setting information is incorporated in the blank period, and is supplied from the display controller 12 to the data driver 14 as a series of serial signals integrated with the video data signal VDS.

Thereafter, as described above, the serial/parallel conversion circuit 21 sequentially writes each piece of video data VD parallel-developed according to the number of outputs of the data driver 14, as the writing data W-Data, in the memory 25 in accordance with the writing clock signal W-CLK having a constant period.

Figure 3B:
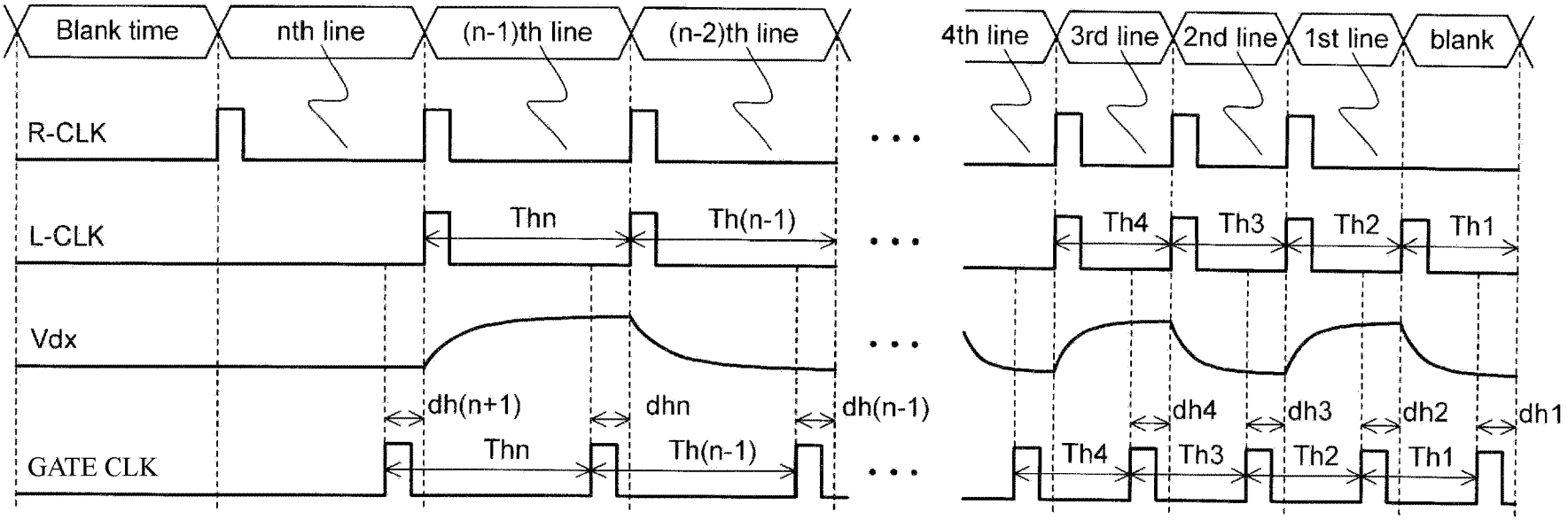
FIG. 3B is a timing chart illustrating clock timings of a readout clock signal and a latch clock signal, and a second gate timing signal.

FIG. 3B is a timing chart in one frame period showing video data and internal signals corresponding to output of the data line DLx similarly to FIG. 3A, and clock timings of the readout clock signal R-CLK, the video data VD read out from the memory 25 on the basis of the readout clock signal R-CLK, and the latch clock signal L-CLK. In addition, FIG. 3B also shows a gradation voltage signal Vdx output from the data driver 14 on the basis of the latch clock signal L-CLK and a gate CLK indicating each timing of a gate signal to be sequentially output to each gate line.

As shown in FIG. 3B, each piece of video data VD read out from the memory 25 is read out in the same order as the order of writing in the memory 25 on the basis of the readout clock signal R-CLK. That is, the video data VD corresponding to the selection period of each gate line is sequentially read out from the memory 25 in the order of the gate lines GLn, GL(n−1), . . . , GL1 (the order from a side distant from the data driver 14 toward a side close thereto). Here, in the readout clock signal R-CLK, clock timings are modulated so that the data period of the video data VD written in a pixel row distant from the data driver 14 becomes longer than the writing clock signal W-CLK, and that the data period of the video data VD written in a pixel row close from the data driver 14 becomes shorter than the writing clock signal W-CLK. Meanwhile, since the period of the writing clock signal W-CLK (or, the data period of the video data VD to be written) and the period of the readout clock signal R-CLK (or, the data period of the video data VD to be read out) are different from each other with respect to the same the video data VD, data is temporarily held in the memory 25 for the period of this timing difference.

In addition, the latch clock signal L-CLK for determining a timing (one data period) of output from the data driver 14 to a data line becomes, for example, a clock signal for delaying the readout clock signal R-CLK by one data period. The gradation voltage signal Vdx on which digital-analog conversion is performed is output from the data driver 14 to the data line DLx on the basis of the latch clock signal L-CLK. In FIG. 3B, each data period in which the gradation voltage signal Vdx is output is generated at timings (Thn, Th(n−1), . . . , Th1) from the rising edge of the latch clock signal L-CLK to the next rising edge. That is, one data period of a data signal Vdx supplied to a pixel on a side close to the data driver 14 (data line near end) is set to be short, and one data period of the gradation voltage signal Vdx supplied to a pixel on a side distant from the data driver 14 (data line far end) is set to be long. Meanwhile, the output waveform of the gradation voltage signal Vdx in FIG. 3B shows a waveform example in which a maximum gradation voltage and a minimum gradation voltage are alternately output for convenience of illustration.

The gate CLK (the gate timing signal TS in FIG. 2) is generated in the timing generator 24 on the basis of the gate timing signal GS1 and the modulated data timing signal. The gate CLK is generated at timings deviated from the rising edge (timing in one data period) of the latch clock signal L-CLK by predetermined periods (dh(n+1), dhn, dh(n−1), . . . , dh1). The selection periods (that is, pulse widths) of the gate signals Vgn, . . . Vgk . . . , Vg1 corresponding to the gate lines GLn, . . . GLk . . . , GL1 are set on the basis of the timing of this the gate CLK. The gate timing signal GS2 according to drive circuits of the gate drivers 13A and 13B is generated in the buffer 29 on the basis of the timing of the gate CLK.

Meanwhile, in a large-screen display device, precharge of a gate signal may be performed in order to increase a charging rate of a gradation voltage signal with respect to a pixel electrode. In a case where precharge of a gate signal is performed, for a gate signal which selects a gradation voltage signal for charging a pixel electrode, the selection period of a gate signal is started from multiple prior selection periods with respect to the selection period of the gate signal corresponding to the data period of the gradation voltage. That is, the pulse width of the gate signal is set over a plurality of selection periods. For example, regarding a selection period Thk of the gate signal Vgk to be set in the gate CLK of FIG. 3B, the gate timing signal GS2 may be generated so as to become a gate signal of which the pulse width is extended from multiple prior selection periods to the selection period Thk.

Figure 4:
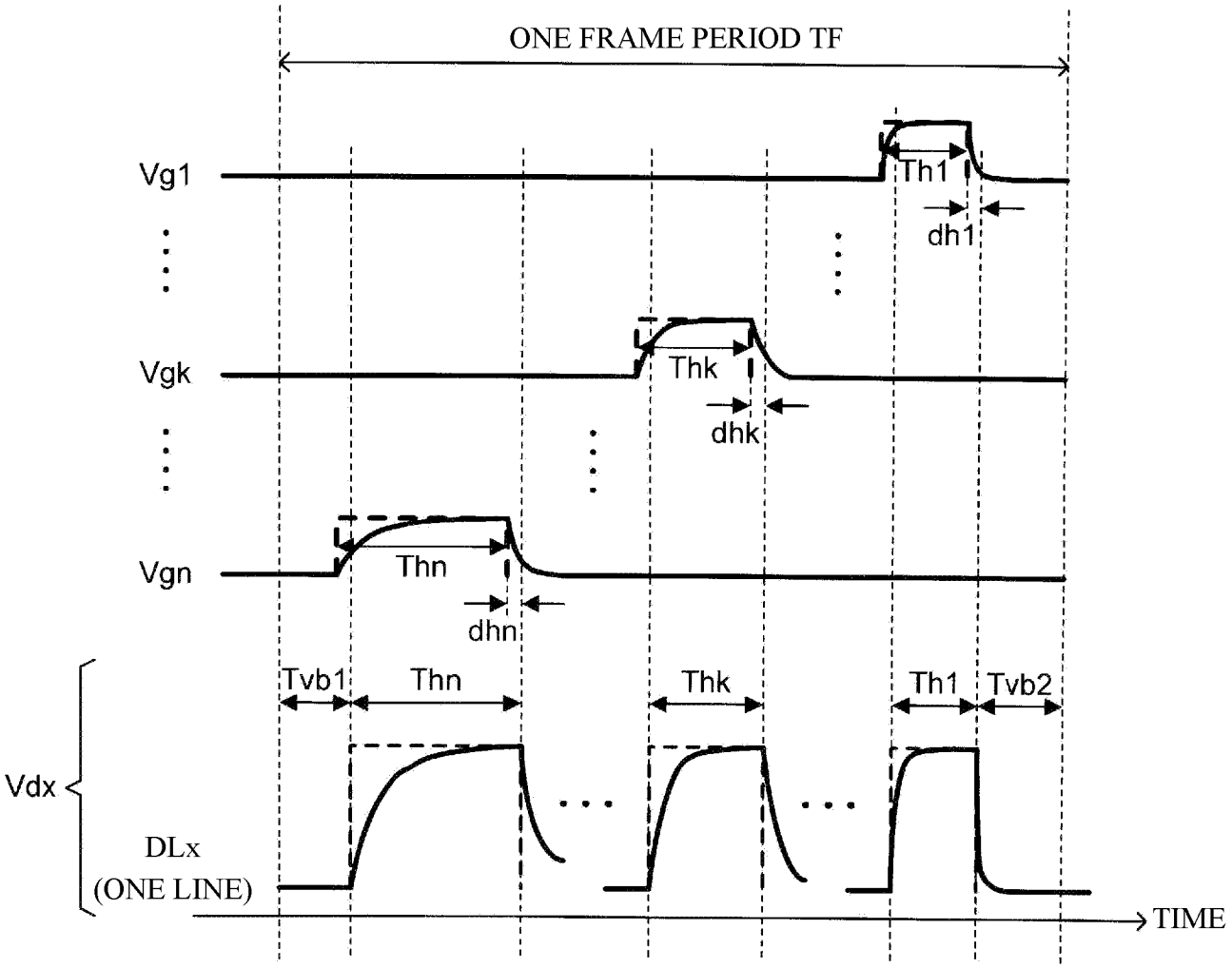
FIG. 4 is a diagram illustrating signal waveforms in one frame period of a gate signal supplied to each gate line and a gradation voltage signal Vdx supplied to the data line DLx.

FIG. 4 is a diagram illustrating signal waveforms in one frame period of the gate signals Vg1, . . . Vgk . . . , Vgn output from the gate driver 13A or 13B of the present example to the respective gate lines and the gradation voltage signal Vdx output from the data driver 14 to the data line DLx. Meanwhile, the gradation voltage signal Vdx represents a signal waveform changing from a low-potential gradation voltage to a high-potential gradation voltage in one data period corresponding to the selection periods (Th1, Thk, Thn) of the gate signals for convenience of description relating to signal delay.

Here, regarding the supply of the gradation voltage signal Vdx, one data period on the data line far end is denoted as Thn, and one data period on the data line near end is denoted as Th1. Regarding one data period for the gradation voltage signal Vdx, each data period is set so that one data period becomes shorter on the data line near end, and one data period becomes longer toward the data line far end side.

Since the influence of impedance of a data line is small on the data line near end, blunting of a rise in a signal waveform is small. Therefore, even in a case where one data period Th1 becomes shorter, the voltage level of the gradation voltage signal Vdx output from the data driver 14 can be written in a pixel electrode on the data line near end as it is.

In contrast, on the data line far end, a rise in a signal waveform is greatly blunted under the great influence of the impedance of a data line. However, since one data period Thn is long, it is possible to reach the voltage level of the gradation voltage signal Vdx output from the data driver 14, and to write the voltage level in a pixel electrode on the data line far end. Thereby, for an entire screen display having a same gradation level, it is possible to uniform a pixel charging rate in the direction of a data line dependent on the impedance of a data line.

On the other hand, the gate signals Vg1, . . . Vgn are set so that their pulse widths (selection periods) increase from the data line near end toward the far end in accordance with one data period of the gradation voltage signal Vdx. That is, the pulse width of the gate signal Vg1 for selecting a pixel on the data line near end is short, and the pulse width of the gate signal Vgn for selecting a pixel on the data line far end is long. Thereby, it is possible to uniform the pixel charging rate of the same gradation voltage signal with respect to a pixel in the direction of a data line. FIG. 4 shows an example that the pulse width of a gate signal is set at the same level as one data period. Here, as described above, the pulse width of the gate signal may be widened in order to perform precharge of the gate signal.

In addition, the gate signals Vg1 to Vgn are sequentially output from the gate drivers 13A and 13B in the order from the data line far end toward the data line near end, that is, in the order of Vgn, . . . , Vgk, . . . , Vg1. The gradation voltage signal Vdx selected in each of the gate signals Vgn, . . . , Vgk, . . . , Vg1 is sequentially output the data line DLx.

Meanwhile, the output order of the gate signals Vg1 to Vgn can also be set to the order from the data line near end toward the data line far end reversely to FIG. 4, that is, the order of Vg1, . . . , Vgk, . . . , Vgn. However, in this case, since the readout of the video data VD from the memory 25 is always later than the writing of the video data VD in the memory 25, the timing of the readout clock signal R-CLK at which initial video data VD is read out from the memory 25 is required to be made later by a predetermined period than the timing of the writing clock signal W-CLK at which the initial video data VD is written in the memory 25. In this case, a timing difference between the writing clock signal W-CLK and the readout clock signal R-CLK may be larger than in the case of FIG. 4, and the memory capacity of the memory 25 required for temporarily storing video data may increase.

On the other hand, in a case where the gate signals are output in the order of Vgn, . . . , Vgk, . . . , Vg1 as shown in FIG. 4, the period of the clock timing of the readout clock signal R-CLK in which the video data VD is read out is longer than the period of the constant clock timing of the writing clock signal W-CLK in which the video data VD is written in the memory 25 immediately after readout start, and the period decreases gradually. Therefore, the readout of the initial video data VD can be started from a timing which is slightly delayed from the writing of the initial the video data VD. In this case, a timing difference between the writing clock signal W-CLK and the readout clock signal R-CLK is small, and thus it is possible to reduce the memory capacity of the memory 25 required for temporarily storing video data.

In addition, in the present example, timing differences dh1, . . . dhk . . . dhn between the data signal Vdx and the gate signals Vg1 to Vgn are adjusted in accordance with a distance from the gate driver 13A or 13B. For example, on the gate line far end, since a timing at which the gate signal Vgn is turned off (changed from a high level to a low level) is late, the timing difference dhn is required to be set to be large so that even a gradation voltage signal to be selected in the next gate signal Vg (n−1) is selected in the gate signal Vgn and erroneous charging does not occur in a pixel electrode. Meanwhile, the timing differences dh1, . . . dhk . . . dhn may be configured to be made variable in accordance with a distance on a data line from the data driver 14.

In FIG. 4, timing differences dh1, . . . dhk . . . dhn between the data signal Vdx and the gate signals Vg1 to Vgn are set by timing difference between the end timing of the selection period of each gate signal and the end timing of each data period of the data signal Vdx.

Figure 5:
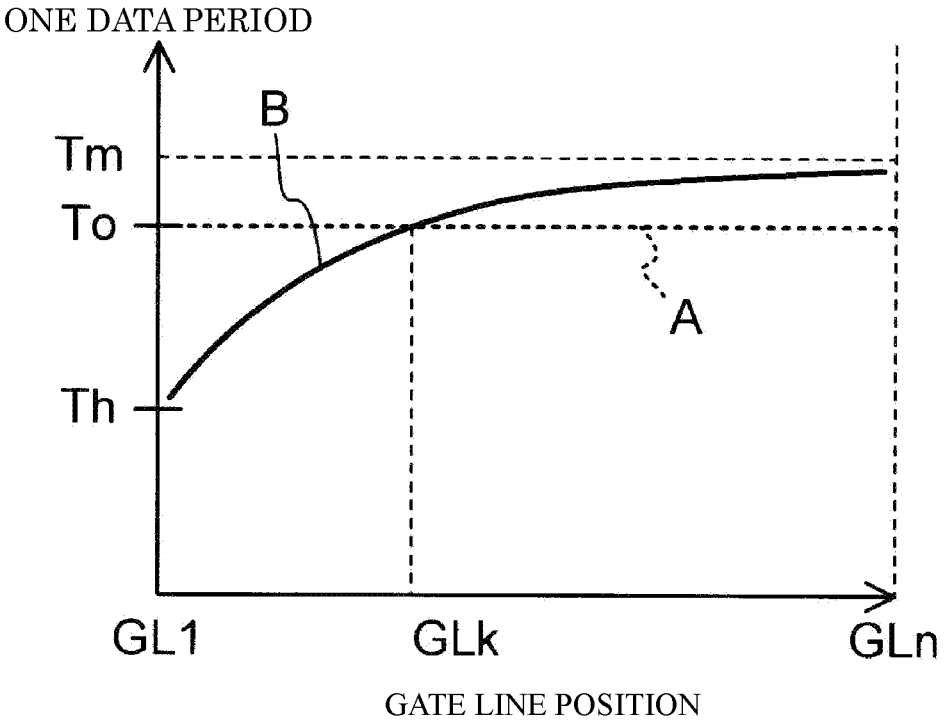
FIG. 5 is a diagram illustrating a correspondence relation between one data period and a position of each gate line away from each data driver.

FIG. 5 is a diagram illustrating a correspondence relation between one data period when the gradation voltage signal Vdx corresponding to the video data VD is written and the position of each of the gate lines GL1, . . . , GLn from the data driver 14.

Unlike the display device 100 of the present example, in a case where the writing period of the gradation voltage signal Vdx is made constant regardless of the position of a gate line from a data driver, the length of one data period is constant (constant value To shown in FIG. 5) as shown by a broken line A.

In contrast, in the display device 100 of the present example, as shown by a solid line B, one data period and a gate selection period on the gate line GL1 side close to the data driver 14 are set to be short, and one data period and a gate selection period on the gate line GLn side distant from the data driver 14 are set to be long. Meanwhile, the characteristic curve of the solid line B becomes a curve dependent on the impedance of a data line corresponding to a gate line position from the data driver 14 (product of wiring resistance and wiring capacity).

In the display device 100 of the present example, one data period is changed from a minimum value Th to a maximum value Tm, and an average value of one data period within one frame period is set to be the vicinity of To. For example, when the readout clock signal R-CLK having a modulation period is generated, the PLL 23 and the timing generator 24 perform control so that an average value of the period becomes substantially the same as the period of the writing clock signal W-CLK having a constant period.

As shown in FIGS. 3A and 3B, in a case where gate lines are sequentially selected from the gate line GLn toward the gate line GL1, the period of the readout clock signal R-CLK is long with respect to the writing clock signal W-CLK having a constant period on the GLn side, and thus the video data VD is required to be stored in the memory 25 for a period equivalent to a timing difference therebetween.

On the other hand, at a timing when the gate line GLk is selected, the writing clock signal W-CLK and the readout clock signal R-CLK are set to have the same period. In addition, the period of the readout clock signal R-CLK is short with respect to the writing clock signal W-CLK on the gate line GL1 side, the readout speed of the video data VD held in the memory 25 increases, and data temporarily stored in the memory 25 decreases gradually. In the present example, timing control is performed so that the data temporarily stored in the memory 25 is minimized at a timing when the last gate line GL1 within one frame period is selected.

The memory 25 has only to have a minimum capacity for temporarily storing the video data VD according to a difference between the writing data W-Data written in the memory 25 and readout data R-Data read out from the memory 25. Meanwhile, the difference between the writing data W-Data and the readout data R-Data corresponds to as large an area as interposed between the broken line A and the solid line B in FIG. 5.

According to the control of the readout clock signal R-CLK as described above, a difference between the writing data W-Data written in the memory 25 and the readout data R-Data is minimized, and thus it is possible to suppress the capacity of the memory 25. In addition, according to the control of the readout clock signal R-CLK as described above, as shown in FIGS. 3A and 3B, both the total time of writing and the total time of readout are controlled so as to fall within one frame period.

As shown in FIG. 5, in the display device 100 of the present example, one data period can be changed from the minimum value Th to the maximum value Tm in accordance with the characteristic curve of the solid line B. In order to further improve a deficiency in a pixel charging rate, the maximum value Tm in one data period may as well become greater (longer) than one data period To of a fixed value described above. However, as the maximum value Tm in one data period becomes greater, the minimum value Th becomes smaller (shorter). In a representative examination example of the inventor, in a case where the minimum value Th in one data period is set to be 0.5 times the period To, the maximum value Tm in one data period is appropriately 1.2 times the period To. As the variable range of this one data period becomes wider, performance of application to various display devices can be further increased. In the display device 100 of the present example, coping with modulation from the minimum value Th to the maximum value Tm in one data period is realized by the memory 25 of the data driver 14.

On the other hand, as described above, in a case where a modulated video data signal is transmitted from a control circuit corresponding to a display controller to a data driver, the transmission frequency of a video data signal has to be doubled in order to set the minimum value Th in one data period to be 0.5 times the period To. It is not easy to double the transmission frequency of a video data signal of a 4K panel or an 8K panel in view of the configuration of a system. Therefore, the display device 100 of the present example including a data driver for receiving a serial image data signal having a predetermined period and changing a timing to a modulated period is suitable for realizing a display device that modulates one data period of a gradation voltage signal supplied to a data line and a gate line of a display panel and the pulse width of a gate signal, and suppresses deterioration in image quality due to a decrease in the charging rate of a pixel electrode.

Figure 6:
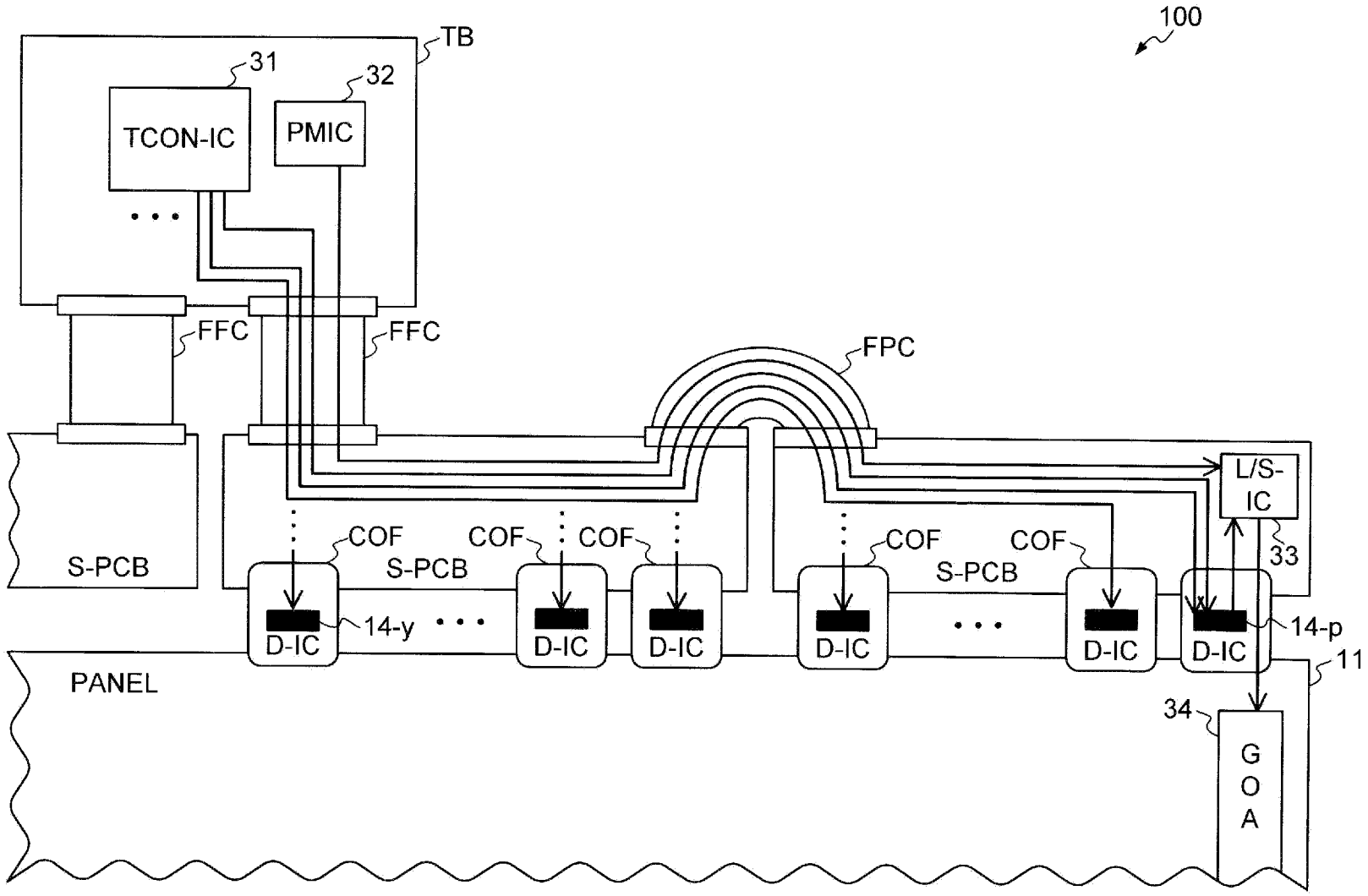
FIG. 6 is a diagram illustrating an example of a system configuration in a case where a display device is configured using a GOA (Gate On Array) technique.

FIG. 6 is a diagram illustrating an example of a system configuration in a case where the display device 100 of the present example is formed as a large-screen panel, and is configured using a gate on array (GOA) technique in which a gate driver is formed integrally with a display panel using a thin-film transistor similarly to a pixel unit of the display panel. Meanwhile, a configuration diagram corresponding to half of the display panel is shown for convenience of illustration.

The display controller 12 is configured as a timing controller (TCON)-IC 31, and is provided in a TCON substrate TB together with a power management (PM) IC 32 that supplies power. The PMIC 32 is configured to be able to supply power supply voltages of a plurality of levels (for example, a high DC (direct current) power supply voltage and a low DC power supply voltage). The gate drivers 13A and 13B are formed on the display panel 11, and the gate driver 13B is shown as a GOA 34 in FIG. 6.

The data drivers 14-1 to **14-*p* are constituted by driver ICs (which are D-ICs in the drawing, and are denoted as 14-*y* to 14-*p* corresponding to half of the display panel). Each driver IC is mounted on a chip on film (COF). Each COF connects an S-PCB (printed circuit board) and the display panel. In a large-screen panel, a plurality of S-PCBs is provided by the restriction of a PCB size, and the S-PCBs are connected to each other by flexible printed circuits (FPC) through a cable connector. The TCON-IC 31** and an S-PCB on the center side of the display panel are connected to each other by a flexible flat cable (FFC) through a cable connector.

In addition, an S-PCB located on both ends of the display panel among the plurality of S-PCBs includes an L/S-IC 33 which is a level shift circuit that outputs the gate timing signal GS2 having a high amplitude for a gate signal (a D-IC **14-*p* and an L/S-IC 33 are shown in the drawing). The L/S-IC 33 receives supply of a high DC power supply voltage for a gate signal from the PMIC 32** through wirings of the FFC, the S-PCB and the FPC.

The TCON-IC 31 generates a serial signal in which the video data signal VDS, the clock signal CLK and the control signal CS are integrated with each other, and supplies the generated serial signal to each of the data drivers 14-1 to **14-*p* through wirings of the FFC, the S-PCB (and a portion of the FPC) and the COF. For example, the TCON-IC 31** supplies these signals, as a low-voltage serial differential signal (LV_signal), to each driver IC using a point to point (P to P) system.

In addition, the TCON-IC 31 supplies the gate timing signal GS1 (LV_signal) to a specific driver IC located at an end portion closest to the gate driver 13A or 13B among a plurality of driver ICs of the data drivers 14-1 to **14-*p* (the data driver 14-*p* in the drawing). The specific driver IC that receives supply of the gate timing signal GS1 has a configuration as shown in the block diagram of FIG. 2, and generates the gate CLK (the gate timing signal TS) having a modulation period according to the gate timing signal GS1 and the modulated data timing signal within the specific driver IC. The driver IC generates the gate timing signal GS2 (LV_signal) corresponding to the circuit of the GOA 34 on the basis of the timing of a gate selection period which is set in the gate CLK of FIG. 3B (the gate timing signal TS). The gate timing signal GS2 (LV_signal) output from the specific driver IC is level-converted into a high-voltage signal (HV_signal) by the L/S-IC 33, and is supplied to the GOA 34 on the display panel 11** through the COF of the specific driver IC.

According to such a configuration, the gate timing signal GS1 which is supplied from the TCON-IC 31 to the specific driver IC (the data driver **14-*p***) can be changed to a low-voltage signal (LV_signal), and thus it is possible to reduce the number of signals.

For example, in a large-screen display device, in order to increase a pixel charging rate, the pulse widths of the gate signals Vg1 to Vgn are provided by a positive integer multiple in one data period (for example, two to four times), and thus precharge in the selection period of each of the gate lines GL1 to GLn can be performed. In that case, for example, the number of signals of positive integer multiple×2 is required as the number of high-voltage gate timing signals supplied to the GOA. A configuration is applied in which a plurality of high-voltage gate timing signals generated in the L/S-IC provided in the TCON substrate are supplied to the GOA through long wirings of the FFC, the S-PCB, the FPC, and the COF. On the other hand, in the display device 100 of the present example, even in a case where precharge in the gate signal selection period of the gate lines GL1 to GLn is performed, the gate timing signal GS1 can be changed to, for example, a simple low-voltage signal such as the start pulse of a gate signal. The gate timing signal GS2 required for the GOA may be generated in all the specific driver ICs (the data driver **14-*p*) inclusive of modulation of a pulse width, and be level-converted into a high-voltage signal by the L/S-IC 33 and supplied to the GOA 34. Therefore, in the display device 100 of the present example, the effect of reduction of the number of gate timing signals (GS1) supplied by long wirings through the S-PCB, the FFC, and the FPC from the TCON-IC 31 is great. The effect of reduction of the area of the S-PCB can be obtained by reducing the number of gate timing signals (GS1**).

In addition, the L/S-IC 33 is provided on the S-PCB close to the GOA 34, whereby the wiring distance (the transmission channel) of high-amplitude HV_signal supplied to the GOA 34 is short, and thus the influence of noise on other signals and the signal delay according to the wiring length can be suppressed. Meanwhile, in the wiring of a high DC power supply voltage supplied from the PMIC 32 to the L/S-IC 33, an amplitude is not present in a signal to be transmitted, and thus the influence of noise on other signals hardly occurs.

As described above, in the display device 100 of the present example, the gradation voltage signals Vd1 to Vdm in which one data period is short on the data line near end and one data period is long on the data line far end are generated in accordance with a distance from the data drivers 14-1 to **14-*p* to a pixel which is a writing destination of the video data VD, and are applied to the data lines DL1 to DLm. In addition, the data drivers 14-1 and 14-*p* which are specific drivers generate the gate timing signal GS2 in which the selection period of a gate line changes in accordance with a distance from a data driver to a pixel which is a writing destination of video data in conformity to one data period of the gradation voltage signal. The gate driver that receives the gate timing signal GS2 generates the gate line signals Vg1 to Vgn in which the selection period of a gate line changes in accordance with a distance from a data driver to a pixel which is a writing destination of video data, and applies the generated signals to the gate lines GL1** to GLn, respectively.

According to such a configuration, the display controller 12 transmits the video data signal VDS, the clock signal CLK and the control signal CS which are serialized and integrated with each other in a constant period, and the gate timing signal GS1 having a constant period toward the data drivers 14-1 to 14-*p*. Therefore, in signal transmission between the display controller 12 and the data drivers 14-1 to 14-*p*, a drastic increase in transmission frequency due to the transmission of a modulation signal does not occur. In addition, it is not necessary to perform a change in order to improve the performance of components in a transmission path in accordance with an increase in transmission frequency.

In addition, in the display device 100 of the present example, the data drivers 14-1 and 14-*p* perform not only the generation and output of the data signal Vdx, but also the generation of the gate timing signal GS2. Therefore, a change of the configuration of the display controller 12 (the TCON-IC 31) is not necessary, and thus it is possible to concentrate on a change of the configuration of the data drivers 14-1 to 14-*p*.

Therefore, according to the display device of the disclosure, it is possible to suppress deterioration in image quality while suppressing an increase in the scale of the device.

Example 2

Next, a display device of Example 2 of the disclosure will be described. The display device of the present example is different from the display device 100 of Example 1 in the configuration of a main block of a driver IC included in a data driver.

Figure 7:
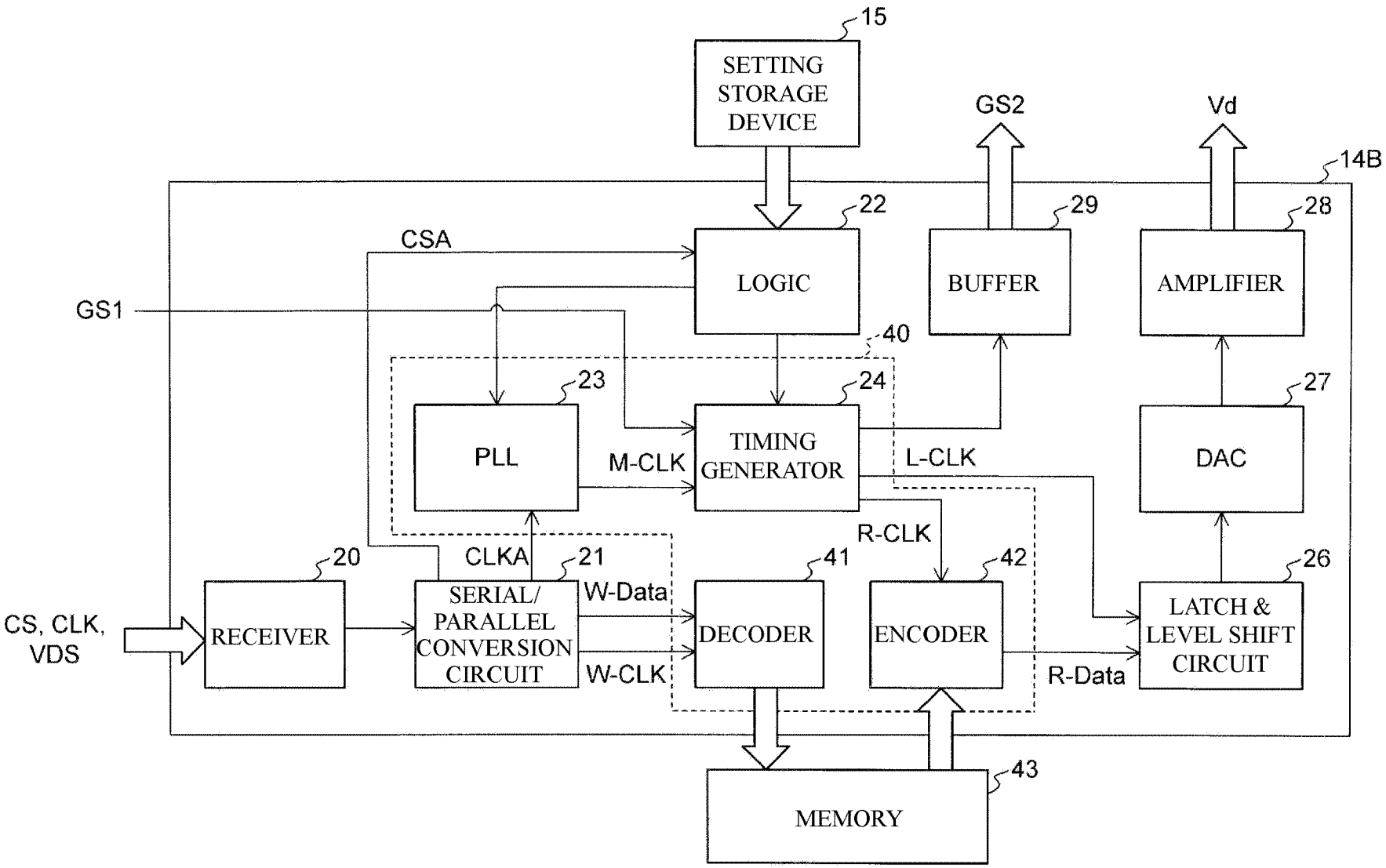
FIG. 7 is a modification example of FIG. 2, and a block diagram illustrating a configuration of a main block of a specific driver.

FIG. 7 is a block diagram illustrating a configuration of a main block of a driver IC 14B included in the specific driver of the present example (that is, the data driver 14-1 or 14-*p*). The driver IC 14B of the present example includes a decoder 41 and an encoder 42. In addition, unlike Example 1, a memory 43 is provided not inside but outside the driver IC 14B. The PLL 23, the timing generator 24, the decoder 41 and the encoder 42 constitute a timing controller 40.

The memory 43 is different from the memory 25 of Example 1 in that it is provided outside the driver IC 14B. In addition, the configurations and operations of functional blocks other than the decoder 41 and the encoder 42 are the same as those of Example 1 shown in FIG. 2.

The decoder 41 is provided between the serial/parallel conversion circuit 21 and the memory 43. The decoder 41 decodes the writing data W-Data and the writing clock signal W-CLK having a constant frequency which are output from the serial/parallel conversion circuit 21 into signals according to the number of writing data buses for connecting the memory 43 and the driver IC 14B and the transmission frequency, and sends out the decoded signals to the memory 43.

The encoder 42 is provided between the memory 43 and the latch & level shift circuit 26. The encoder 42 reads out and encodes signals corresponding to the number of readout data buses for connecting the memory 43 and the driver IC 14B and the transmission frequency from the memory 43 in accordance with the readout clock signal R-CLK which is output from the timing generator 24, and sends out the encoded signals as the readout data R-Data to the latch & level shift circuit 26.

The memory 43 has the same function as that of the memory 25 of Example 1 shown in FIG. 2, except that it is provided outside the driver IC 14B. In addition, the configurations and operations of functional blocks other than the decoder 41 and the encoder 42 are the same as those of Example 1 shown in FIG. 2.

In the present example, since the memory 43 is provided separately from the driver IC 14B, the memory 43 can be realized in a finer process than the driver IC 14B. Therefore, in a case where a memory capacity is relatively large, the cost of a system can be further suppressed than in a case where a memory is built into the driver IC as in Example 1.

Example 3

Next, a display device of Example 3 of the disclosure will be described. The display device of the present example is different from the display device 100 of Example 1, in that a gate driver is configured as not the GOA but the gate driver IC (G-IC).

Figure 8:
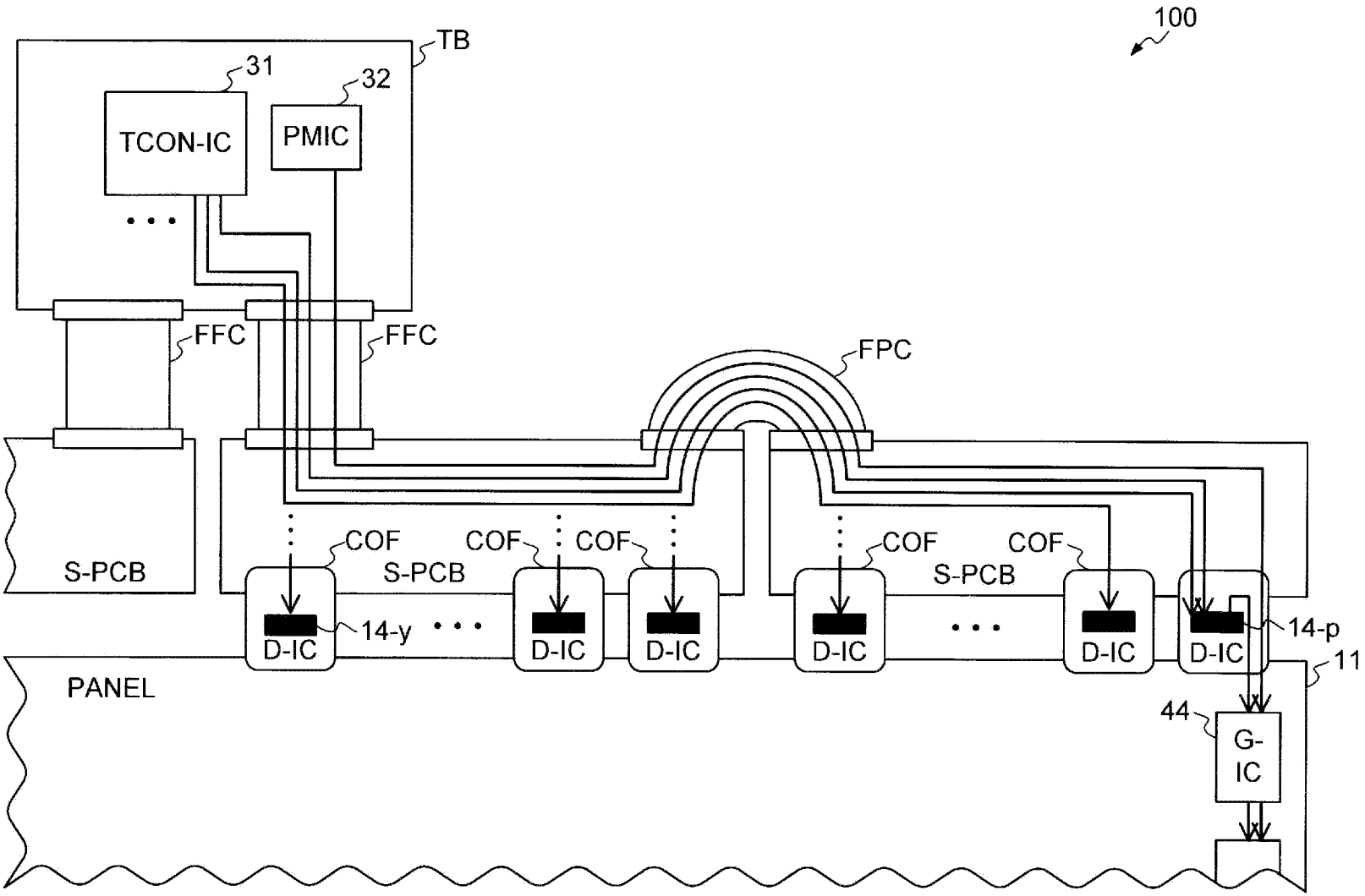
FIG. 8 is a diagram illustrating an example of a system configuration in a case where a gate driver is mounted in a display panel as a silicon IC (G-IC).

FIG. 8 is a diagram illustrating an example of a system configuration in a case where the display panel 11 of the present example is formed as a large-screen panel, and the gate drivers 13A and 13B are configured as a separate gate driver IC (G-IC).

Similarly to Example 1, the TCON-IC 31 supplies the video data signal VDS, the clock signal CLK and the control signal CS which are integrated with each other, as the low-voltage serial differential signal (LV_signal), to each driver IC of the data drivers 14-1 to 14-*p* using P to P. In addition, the TCON-IC 31 supplies the gate timing signal GS1 to a specific driver IC located at an end portion closest to the gate driver 13A or 13B among a plurality of driver ICs of the data driver 14-*p*.

In the present example, unlike Example 1, the L/S-IC 33 is not provided on the S-PCB close to the data driver 14-*p* and the GOA 34, and instead a G-IC 44 has a function of the L/S-IC. Therefore, the gate timing signal GS2 generated in the data driver 14-1 or 14-*p* is supplied to the G-IC 44 mounted on the end portion of the display panel 11 through the COF of the low-voltage signal (LV_signal). In addition, a high DC power supply voltage is supplied from the PMIC 32 to the G-IC 44.

According to such a configuration, since the gate timing signal GS2 is generated in the data driver 14-1 or 14-*p*, the gate timing signal GS1 supplied from the TCON-IC 31 to the data driver 14-*p* can be changed to the low-voltage signal (LV_signal), and the number of the gate timing signals GS1 can be reduced, whereby it is possible to reduce the area of the S-PCB.

Example 4

Next, a display device of Example 4 of this disclosure will be described. The display device of the present example is different from the display device 100 of each of Examples 1-3, in that the gate timing signal GS2 is directly supplied from the display controller 12 to the gate drivers 13A and 13B.

Figure 9:
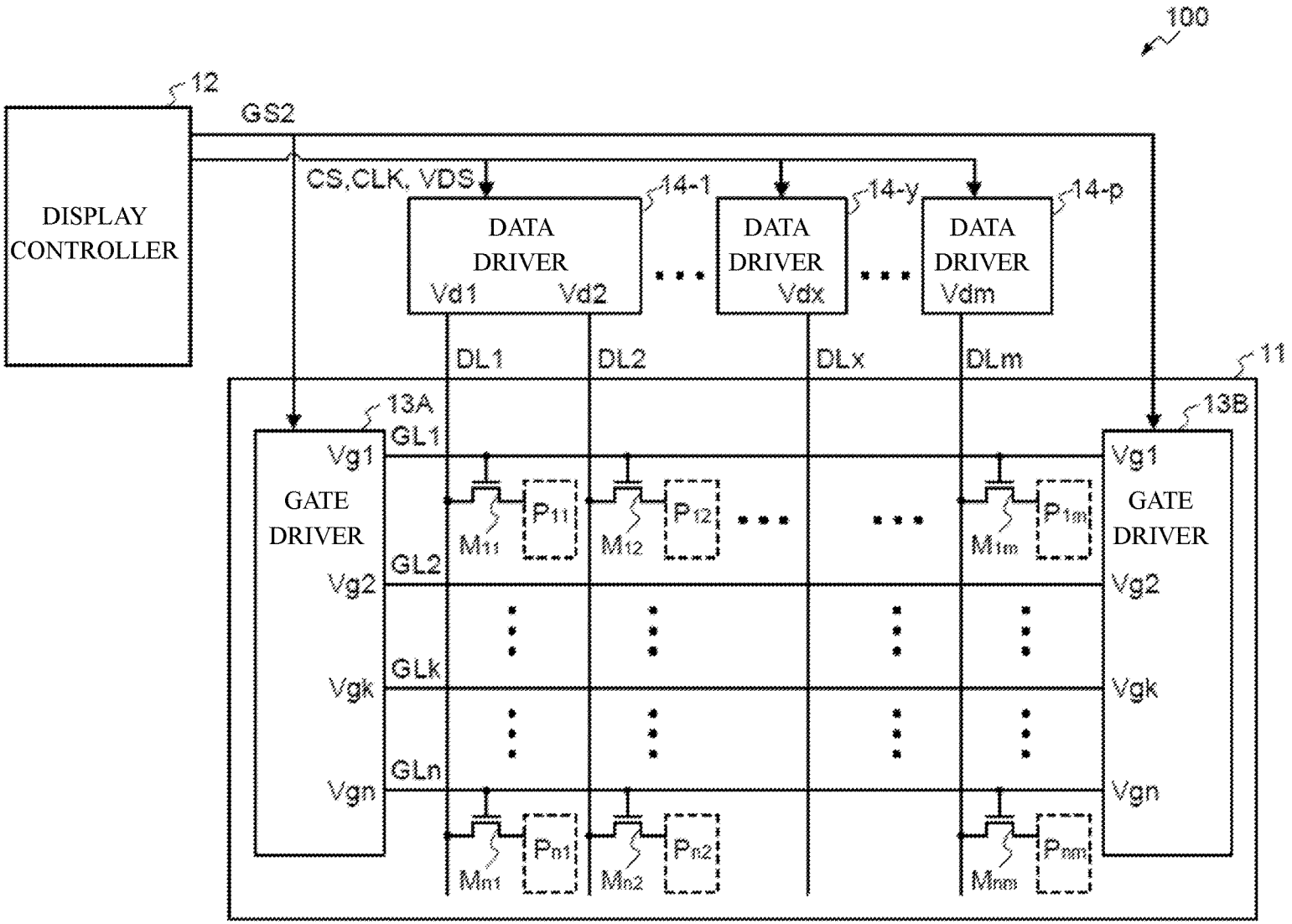
FIG. 9 is a variation of FIG. 1 and a block diagram illustrating a configuration of a display device.

FIG. 9 is a diagram showing an example of the system configuration when the gate timing signal GS2 having a modulated period is generated by the display controller 12.

The transmission frequency of the gate timing signal GS2 is sufficiently lower than the transmission frequency of a serial video data signal supplied from the display controller 12 to each of the data drivers 14-1 to 14-*p*. Therefore, the gate timing signal GS2 can be directly supplied from the display controller 12 to the gate drivers 13A and 13B.

However, in FIG. 9, it is necessary that the display controller 12 has the function of outputting the gate timing signal GS2 with the modulated period. Therefore, it is not possible to simply use the existing display controller which performs the supply of signal at a predetermined frequency, in this system configuration.

Further, in the display device of FIG. 9, a distance between the respective data drivers which generate a modulated data timing signal and the display controller 12 which generates the gate timing signal GS2 is long. Therefore, timing lag is likely to occur due to the effect of signal transmission channels on both a gate signal supplied to the gate line of the display panel 11 and a data line output signal (a gradation voltage signal) supplied to the data line of the display panel 11. For this reason, it is possible to realize high-quality display by mutually setting a timing adjustment function and performing the adjustment of the optimal timing correlation.

The display device of FIG. 9 is designed to change only the modulation of the pulse width (the data period) of a data line output signal (a gradation voltage signal) in each of the data drivers 14-1 to 14-*p*, and does not include a specific driver for outputting a gate timing signal. Other configuration is the same as the display device 100 of Example 1 (FIG. 1).

Further, in the display device in FIG. 9, the gate timing signal GS2 generated by the display controller 12 may be configured by the groups of gate timing signals, and may be supplied to each of the gate drivers 13A and 13B via the L/S-IC as needed. In addition, the gate drivers 13A and 13B may be configured so that the selection timing of a gate signal supplied to each gate line is generated by the timing synthesis of the supplied groups of gate timing signals.

Figure 10:
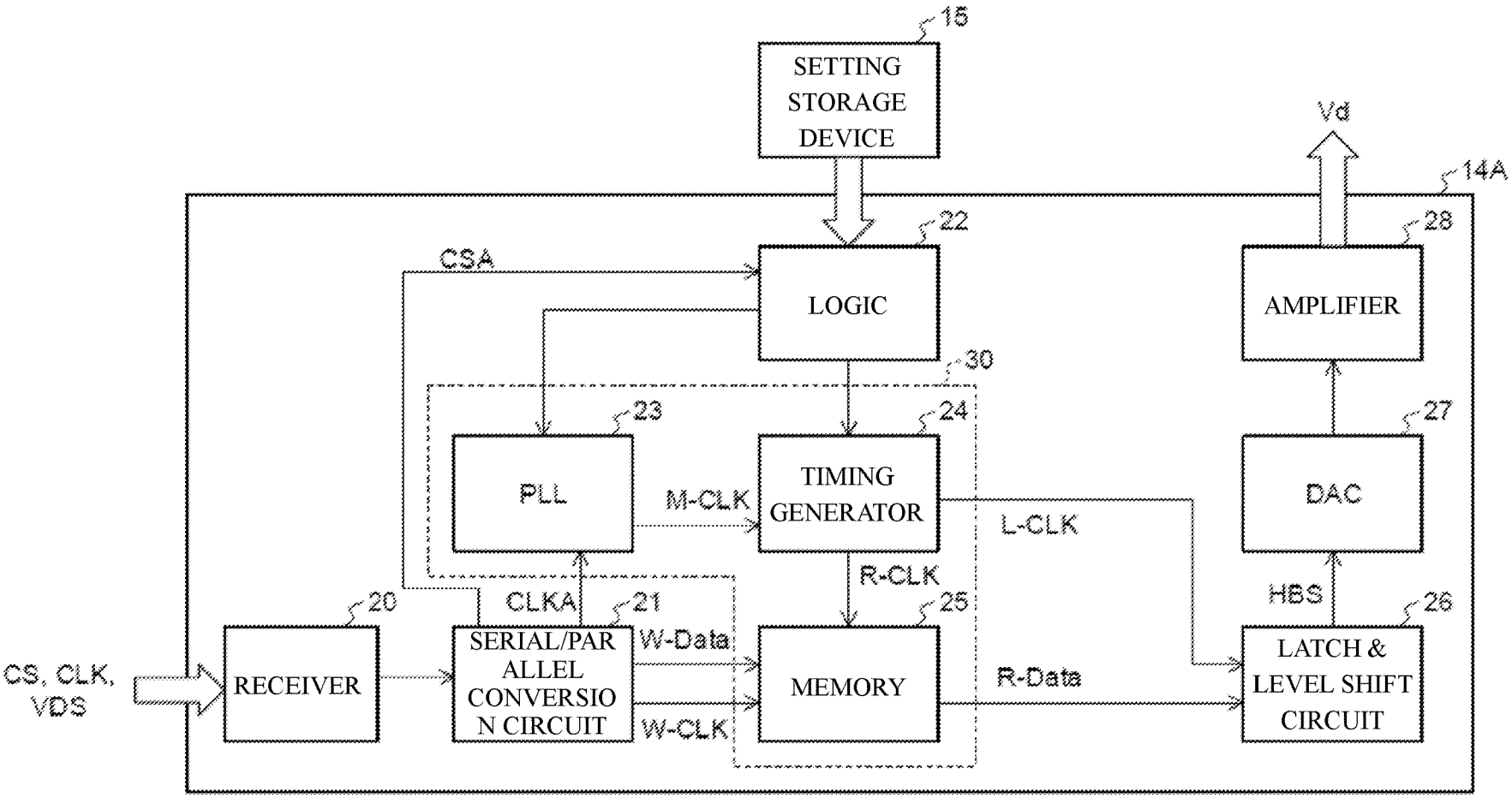
FIG. 10 is a variation of FIG. 2 and is a block diagram illustrating a configuration of a main block of a specific driver.

FIG. 10 is a block diagram showing the configuration of the main block of the driver IC which includes each of the data drivers 14-1 to 14-*p* of the display device of FIG. 9. The driver IC of FIG. 10 is configured by delating the gate timing signals GS1, GS2, TS, and the buffer 29 from the block diagram of the driver IC 14A of FIG. 2. The driver IC of FIG. 10 is the same as the driver IC of FIG. 2 with respect to the functional block related to data timing.

The driver IC of FIG. 10 can be equally applied to each of the data drivers 14-1 to 14-*p* of the display device in FIG. 9. In addition, it can be applied to the data drivers except for the specific drivers 14-1 and 14-*p* in the display device of FIG. 1. Similarly, the configuration (not shown) in which the gate timing signals GS1, GS2, TS, and the buffer 29 are delated from the block diagram (the driver IC 14B) of FIG. 7 of Example 2 can be applied to each of the data drivers 14-1 to 14-*p* of the display device in FIG. 9.

The driver IC 14A of FIG. 2 or the driver IC 14B of FIG. 7 which is set so as not to output the gate timing signal GS2 may be used as the driver IC which includes each of the data drivers 14-1 to 14-*p* of the display device in FIG. 9.

Meanwhile, the disclosure is not limited to the above embodiment. For example, in the above example, a case where the display device 100 is a liquid crystal display has been described. However, unlike this, the display device may be an organic EL (Electro Luminescence) display device. In a case where the display device 100 is an organic EL display device, each of the pixel units $P_{11}$ to $P_{nm}$ includes an organic EL element and a thin-film transistor that controls a current caused to flow into the organic EL element. The thin-film transistor controls a current caused to flow into the organic EL element in accordance with the gradation voltage signals Vd1 to Vdm supplied to the pixel units $P_{11}$ to $P_{nm}$, and the light emission luminance of the organic EL element changes in accordance with the current, whereby display is performed. In the organic EL display device, it is also possible to perform display in which luminance non-uniformity is suppressed by apply the disclosure.

In addition, the display panel 11 may be a color full high definition (FHD) panel, or may be a 4K panel or an 8K panel.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device comprising:

a display panel having a plurality of data lines, a plurality of gate lines, a pixel switch and a pixel unit, the pixel switch and the pixel unit being provided on each of intersection portions between the plurality of data lines and the plurality of gate lines in a matrix form;

a gate driver that is connected to the plurality of gate lines, selects the plurality of gate lines in a predetermined order, and supplies gate signals for controlling the pixel switch to be on in a selection period to the selected gate lines according to a pulse width;

a plurality of data drivers that are provided for the predetermined number of data lines among the plurality of data lines, are connected to the predetermined number of data lines respectively, and provides a gradation voltage signal corresponding to a video data signal to the predetermined number of data lines;

a display controller that generates a signal obtained by serializing a clock signal and the video data signal at a fixed period for each of the predetermined number of data lines and provides the serialized signal to each of the plurality of data drivers, wherein, each of the plurality of data drivers comprises:

a conversion circuit unit that extracts the clock signal and the video data signal from the serialized signal and outputs the clock signal and the video data signal which are extracted as an extracting clock signal and an extracting video data signal;

a phase control unit that performs frequency modulation on the extracting clock signal and generates a modulated clock signal;

a modulated data timing signal generating unit that generates a modulated data timing signal of which frequency changes within one frame period according to the modulated clock signal;

a memory;

a timing control unit that sequentially writes the extracting video data signal of the predetermined number of pixel parts on one of the gate lines in the predetermined order to the memory in synchronization with the extracting clock signal, and reads out the video data signal of the predetermined number of pixel parts on the gate line in a writing order from the memory in synchronization with a readout clock signal according to the modulated data timing signal; and a gradation voltage supply unit that generates the gradation voltage signal corresponding to the readout video data signal every time the video data signal of the predetermined number of pixel parts is read out from the memory, and stores the gradation voltage signal throughout a data period of a cycle of the modulated data timing signal and supplies the gradation voltage signal to the predetermined number of the data lines, wherein the display controller generates a gate timing signal corresponding to the cycle of the modulated data timing signal, and supplies the gate timing signal to the gate driver, the gate driver generates the gate signal having the pulse width based on the cycle of the gate timing signal at a timing of the gate timing signal, as a distance from the data driver of the gate line supplying the gate signal becomes longer, the pulse width of the gate signal becomes longer, as the data period in which the pulse width of the gate signal becomes longer, a supply time of the gradation voltage signal becomes longer.

2. The display device according to claim 1, wherein the modulated data timing signal generating unit generates the modulated data timing signal so that as a distance on the data line from the data driver to the pixel unit as a writing destination becomes longer, a cycle within the one frame period becomes longer, and the data period is a period for writing the gradation voltage signal to the pixel unit, and the display controller generates the gate timing signal so that as the distance from the data driver of the gate line supplying the gate signal becomes longer, the cycle within the one frame period becomes longer.

3. The display device according to claim 2, wherein the pulse width of the gate signal is set to include a plurality of the data periods.

4. The display device according to claim 2, wherein a timing difference between an end timing of the data period for writing the gradation voltage signal to the pixel unit and an end timing of the selection period of the gate signal is set to a larger value as a distance on the gate line from the gate driver is longer.

5. The display device according to claim 2, wherein a timing difference between an end timing of the data period for writing the gradation voltage signal to the pixel unit and an end timing of the selection period of the gate signal is set to a larger value as a distance on the data line from the plurality of data drivers is longer.

6. The display device according to claim 1, wherein the conversion circuit unit includes a serial-parallel converter circuit that generates a plurality of extracting video data signals which are converted in parallel, according to the predetermined number of data lines, from the video data signal supplied as the serialized signal;

the gradation voltage supply unit includes a digital to analog converter circuit that converts the readout video data signal to the gradation voltage signal; and an amplifying circuit that amplifies the gradation voltage signal and outputting the amplified gradation voltage to the predetermined number of data lines for each of the data periods.

7. The display device according to claim 1, wherein the modulated data timing signal has a cycle for a plurality of different data periods within the one frame period, and an average value of the plurality of different data periods is the same as the value of the clock period of the clock signal.

8. The display device according to claim 1, wherein the gate driver has a first gate driver connected to one end of each of the plurality of gate lines and a second gate driver connected to another end of each of the plurality of gate lines, the gate timing signal includes a first gate timing signal supplied to the first gate driver and a second gate timing signal supplied to the second gate driver, the first gate driver and the second gate driver generate the gate signals based on timing synthesis by the first gate timing signal and the second gate timing signal.

9. A data driver connected to a display panel including a plurality of data lines, a plurality of gate lines, a pixel switch and a pixel unit, the pixel switch and the pixel unit being provided on each of intersection portions between the plurality of data lines and the plurality of gate lines in a matrix form, the data driver supplying a gradation voltage signal corresponding to a video data signal to the plurality of data lines, the data driver comprising:

a conversion circuit unit that receives a clock signal and the video data signal which are serialized at a fixed period supplied from a display controller, and extracts as an internal clock signal and internal video data signal with a fixed cycle whose frequency is lowered by serial-parallel conversion;

a timing signal generating unit that generates a data timing signal with the fixed period generated according to the internal clock signal and a modulated clock signal obtained by performing frequency modulation on the internal clock signal, and generates modulated data timing signal of which frequency changes within one frame period according to the modulated clock signal;

a memory that writes the internal video data signal in the predetermined order in synchronization with the data timing signal, and reads out the internal video data signal in synchronization with the modulated clock signal; and a gradation voltage supply unit that generates the gradation voltage signal by performing a digital to analog conversion on the internal video data signal read out from the memory, and supplies the gradation voltage signal to the plurality of data lines, wherein, a data period of the gradation voltage signal supplied to the pixel portion is lengthened as the pixel portion is located at a far end side of the data line from the data driver within the one frame period.

10. The data driver according to claim 9, wherein the memory includes a memory capacity that temporarily stores the internal video data signal according to a timing difference between the data timing signal and the modulated data timing signal.

11. The data driver according to claim 9, wherein the timing signal generating unit receives a gate timing signal having a predetermined period from outside, generates a modulated gate timing signal whose period changes within the one frame period based on the gate timing signal having the fixed period and modulated data timing signal, and supplies the generated modulated gate timing signal to a gate driver connected to the display panel.

* * * * *